US005660878A

United States Patent [19]

Le Gressus et al.

[11] Patent Number: 5,660,878

[45] Date of Patent: Aug. 26, 1997

[54] PROCESS FOR THE REDUCTION OF BREAKDOWN RISKS OF THE INSULANT OF HIGH VOLTAGE CABLE AND LINES DURING THEIR AGING

[75] Inventors: Claude Le Gressus, Fontenay-le-Fleury; Claude Faure, Lesigny; Pierre Bach, Maison Alfort; Guy Blaise, Clichy, all of France

[73] Assignee: Commissariat a l'Energie Atomique, Paris, France

[21] Appl. No.: 442,571

[22] Filed: May 16, 1995

Related U.S. Application Data

[63] Continuation of Ser. No. 90,049, filed as PCT/FR92/00101, Feb. 5, 1992, published as WO92/14253, Aug. 20, 1992, abandoned.

[30] Foreign Application Priority Data

Feb. 6, 1991 [FR] France ..... 91 01310

[51] Int. Cl.[6] ..... B05D 1/12; B05D 3/02; B05D 5/12

[52] U.S. Cl. ..... 427/118; 427/120; 427/205; 427/229; 156/47

[58] Field of Search ..... 156/47, 48, 89; 264/61, 104, 135; 252/512; 501/127; 174/110 R, 120 SC, 118, 137 R, 110 A; 427/120, 117, 191, 192, 196, 118, 205, 229

[56] References Cited

U.S. PATENT DOCUMENTS

| | | | |
|---|---|---|---|
| 3,179,544 | 4/1965 | Smith-Johannsen | 156/276 X |
| 3,925,261 | 12/1975 | Lauterbach-Dammler | 264/61 X |
| 3,953,371 | 4/1976 | May | 264/61 X |
| 4,064,074 | 12/1977 | Ellis | 29/611 X |
| 4,317,856 | 3/1982 | Huthwelker et al. | 427/96 X |
| 4,397,773 | 8/1983 | May | 264/61 X |
| 4,426,339 | 1/1984 | Kamath et al. | 264/105 X |
| 4,487,733 | 12/1984 | Palilla et al. | 264/61 |
| 4,544,828 | 10/1985 | Shigenobu et al. | 29/612 X |
| 4,588,855 | 5/1986 | Kutsuwa et al. | 174/120 SC |
| 5,248,517 | 9/1993 | Shrier et al. | 427/58 |
| 5,279,886 | 1/1994 | Kawai et al. | 264/61 X |

FOREIGN PATENT DOCUMENTS

| | | |
|---|---|---|
| 638517 | 3/1962 | Canada . |
| 7703498 | 11/1977 | France . |
| 2357992 | 2/1978 | France . |
| 307442 | 8/1955 | Switzerland . |
| 669277 | 2/1989 | Switzerland . |
| 640465 | 7/1950 | United Kingdom . |
| 9214253 | 8/1992 | WIPO . |

OTHER PUBLICATIONS

"A Survey of Electrical Ceramics", Robinson, The Proceedings of the Institution of Electrical Engineers, Part IIA, vol. 100, 1953.

*Primary Examiner*—Michael W. Ball
*Assistant Examiner*—Francis J. Lorin
*Attorney, Agent, or Firm*—Pearne, Gordon, McCoy & Granger LLP

[57] ABSTRACT

Process for the reduction of breakdown risks with respect to the solid dielectric insulant of transmission cables and lines operating under high voltages. The insulant normally separates the conductors of a multi-conductor line or the central conductor and the outer metal envelope of a coaxial line. Small amounts of metal particles with dimensions below 1 micron are added to the dielectric insulant mass.

6 Claims, 1 Drawing Sheet

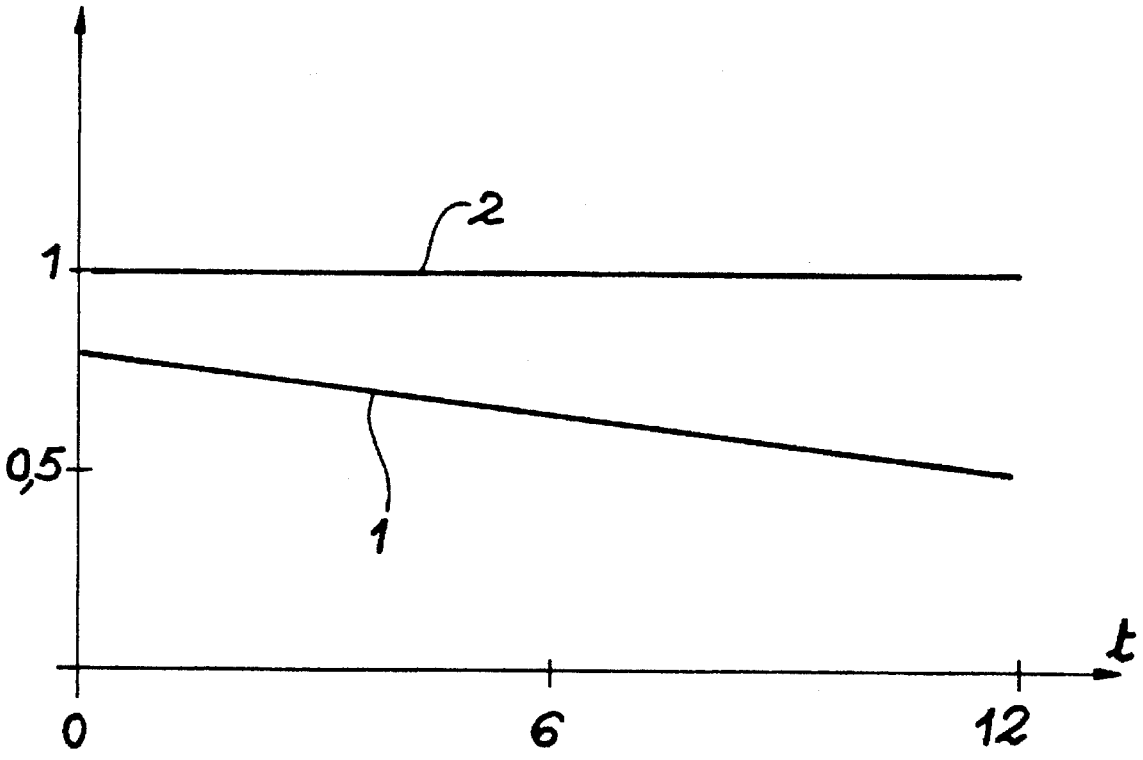
2
1
0,5
1
t
0
6
12

PROCESS FOR THE REDUCTION OF BREAKDOWN RISKS OF THE INSULANT OF HIGH VOLTAGE CABLE AND LINES DURING THEIR AGING

This is a continuation of application Ser. No. 08/090,049, filed as PCT/FR92/00101 Feb. 5, 1992 and published as WO92/14253 Aug. 20, 1992, now abandoned.

BACKGROUND OF THE INVENTION

The present invention relates in general terms to high voltage transmission lines and cables.

It is more particularly directed at reducing the breakdown risks inherent in all solid dielectric insulants used in the aforementioned transmission means, said risks increasing during the aging of the insulant.

Transmission cables and lines have a great diversity as a function of the voltage, current and frequency ranges under which they are used. The transportation of high power levels up to a place of use often takes place with lines having 2, 3 or 4 conductors or wires under a low frequency, e.g. 400, 60 or 50 Hz and in direct current form.

Signals are generally transmitted by a twin-conductor line or by a coaxial line as a function of the frequencies to be transmitted and the transmission conditions.

For reasons of clarity and simplification, a description will only be given here of coaxial cables, but it is obvious that the invention applies to all insulants used in the different types of lines, the line portions constituting insulant "passages" and the high voltage means having solid insulants.

One of the main reasons for high voltage equipment failing is an electric breakdown, which occurs between the conductors across the insulants or insulators (sometimes preceded by a partial electric discharge) leading to the perforation of the insulant and the latter may even be destroyed. The failure occurs in a random manner, but it is found that this risk increases greatly over a period of time as a result of the ageing process.

This problem of the reliability and service life of insulants is a considerable preoccupation for the manufacturers of cables and this state has existed for a long period of time. The hitherto very limited knowledge of the physical phenomena involved has not made it possible to find effective solutions.

Since, by definition, lines have a very considerable length compared with the wavelength, the approximation of standing waves cannot be applied thereto. The study of the transmission, energy absorption and therefore ageing phenomena can only take place on the basis of MAXWELL equations, conditions at the limits defined by the separating surfaces between the different media and relations specific to the media in question.

Without wishing to go into detail concerning the theory of transmission lines, it is pointed out that for a perfect conductor, the local charge density is zero, whereas for a dielectric the local electric field can be considered as the sum of the electrostatic field due to the electric charges developing therein and the field calculated by the MAXWELL equations in the uncharged medium.

If the media were perfect, the electric and magnetic fields would be zero in the conductors end would be in phase and unattenuated in the insulants, in such a way that the electric and magnetic energies would be equal. In practice, conductors and insulants are not perfect and two types of faults or defects occur, namely volume defects and interface defects.

The standard process for increasing the breakdown threshold of a coaxial cable consists of increasing the dielectric material thickness. However, a limitation is obviously imposed by dimensional considerations (size and price) and in any case the aging faults remain. Other ideas and various processes have been conceived, all based on the fact that the existence of charges in the insulating dielectric mass is inevitable and that their prejudicial effects are limited by the application of other fields aimed at deflecting them, or by reducing the fields as a result of special geometrical arrangements.

For example, FR-A-2,349,932 (Ser No. 7703498) describes a transmission line having a device located outside the dielectric region and whose aim is to create a magnetic field, so that the charged particles present in the dielectric undergo a helical movement. Thus, the probability of a charged particle reaching the energy level corresponding to ionization becomes very low. This process is without doubt effective in the case of a cable having a gaseous insulant (e.g. $SF_6$), but it is not justified for a solid insulant, which is the general case for industrial applications.

Using different procedures, attempts have already been made to improve the operation of the dielectrics of electric cables and give them better performance characteristics with respect to the constraints and stresses which they undergo.

Reference is e.g. made to FR-A-2 357 992, which describes an electric cable in which the insulant has a gradation of the permittivity from the central conductor to the external conductor. This gradation is obtained by using insulating layers in which large quantities of oxides (80 to 100%) have been added. The objective of this document is to minimize the prejudicial effects on the breakdown of a lack of symmetry or concentricity of the cable. In addition, CH-A-669 277 describes a cable having several layers of insulating material with different permittivities. The aim is to improve the manufacturing constraints by reducing the thickness of the insulator.

However, neither of these documents discloses means for specifically combatting the increase in breakdown risks as a function of aging.

SUMMARY OF THE INVENTION

The present invention is specifically directed at a process for reducing breakdown risk of insulants in electrical transmission systems making it possible to significantly improve the previous situation.

This process for reducing breakdown risks with respect to the insulant of high voltage cables and lines during their ageing is characterized in that to the insulant mass are added particles of elements having a very high permittivity, the size of these particles being at the most approximately 1 micrometer and they represent approximately 3% of the insulant mass.

A fundamental study of the breakdown phenomena carried out by the applicant has made it possible to give a new interpretation thereto by linking the breakdown phenomena with the polarization of the dielectric and its relaxation. It is firstly pointed out that the electric field $\vec{E}$ applied to a dielectric and the polarization $\vec{P}$ of the latter resulting from the application of this field, are linked by the formula $\vec{P}=\epsilon\vec{E}$, in which $\epsilon$ is a dimensionless quantity designated as the permittivity of the dielectric. It represents the varying possibility of the dielectric to polarize itself, i.e. accept electric charges under the influence of an electric field applied.

However, the aforementioned fundamental study has revealed the fact that this local permittivity of the dielectric plays an essential role in the breakdown phenomena.

The role of the local permittivity is more marked when the volumes in question are at a submicrometric scale. At this scale the macroscopic notion of permittivity is no longer meaningful and it is necessary to consider both the electric charge present in the dielectric trapped in a potential well and the surrounding medium constituted by a structure of about 100 atoms. This forms what is called a polaron.

As the dielectric is subject on the one hand to electric and magnetic fields and on the other hand has a non-zero charge density, the aim must be to reduce this charge density or better distribute the same. The latter is the superimposing of volume charges (characteristics of the nature and state of the material) and charges injected at the interfaces by the polarity of the conductors. Therefore action can be taken on the nature of the material and on modifications of its properties.

Thus, according to the invention, modifications take place to the properties of the dielectric material by adding to it small amounts of particles constituted by elements having a very high permittivity and with dimensions below 1 micron. At this scale, there is a strong interaction between the electric charges in the potential well and the surrounding atoms, which ensures a very high stability of the trapping of the charges, whose mobility is the essential cause of ageing. It is found that the thus doped material not only has a higher breakdown threshold, but also a high resistance to aging under normal operating conditions, i.e. in the presence of an electric field. The best results were obtained with metal particles.

According to an embodiment of the invention, when the dielectric insulant is refractory, e.g. constituted by a ceramic material, the electrical properties ere modified by doping the insulating material with the aid of particles of an oxide of a metal chosen from among chromium, titanium and manganese in the submicron state. After the insulant is sintered, the particles are deposited in the form of a paint on at least one of the surfaces of the insulant and the conductor and which is then diffused into the insulant by heating to high temperature of approximately 1000° to 1500° C. At this temperature, the metal oxide is dissociated and the metal diffuses into the joints of grains of the ceramic material.

According to a second embodiment of the invention, when the insulant is constituted by a polymer or an organic solid, the electrical properties are modified by doping the insulant with metal impurities. In the latter case, doping can take place, according to the invention, by injecting metal powder during the polymer casting operation, the powder particles having a size which is necessarily below 1 micrometer.

BRIEF DESCRIPTION OF THE DRAWING

The invention will be better understood by referring to the following description of specific embodiments and the attached FIGURE, which shows the compared properties of a treated cable and an untreated cable.

DETAILED DESCRIPTION OF PREFERRED EMBODIMENTS

In general terms, it is pointed out that all known insulating dielectrics can be used within the scope of the present invention. In other words, these dielectric insulants can either be polymers for producing cables, or ceramics for producing passages and electrical connectors, or more generally of any organic or mineral, solid insulant.

As has been stated hereinbefore the chosen dielectric insulating material determines the doping treatment used. Thus, e.g. in a first embodiment of the invention, a coaxial insulating passage is produced with the aid of an alumina ceramic $Al_2O_3$ of 99% purity and formed by a sintering of 1 to 7 micron grains before doping. As this ceramic is clearly refractory, the doping can take place at high temperature. In practical terms, it is a question of diffusing a metal into the joints of the grains of the ceramic. In this case, as the metal is chromium, a chromium oxide paint is deposited either on the conductor surface, or on the insulant surface, or on both at once. Following the installation of the conductor in the insulant, the thus deposited chromium is diffused by a heating operation at approximately 1000° to 1500° C. The heating temperature and duration are a function of the ceramic dimensions. For information purposes, for a passage with a diameter of 1 centimeter and a d.c. voltage of 100 kV, diffusion takes place for 5 minutes at 1200° C. The metal level in the joints is approximately 3%.

The effect of this treatment was measured over a 12 month period. The measured parameter is the value of the electric shocks which can be withstood by the insulant in operation without any breakdown. Whereas for the untreated ceramic the breakdown behaviour is 800 kV/cm at the start of use and 400 kV/cm after 12 months, the ceramic doped according to the process of the invention withstands 1.5 MV/cm at the start of use and still withstands 1.2 MV/cm after 12 months operation.

According to a second embodiment of the invention, the dielectric insulant used is a polymer doped at a relatively moderate temperature of approximately 200° to 300° C., e.g. with metal impurities. These impurities are powders and doping takes place at the time of casting the polymer in the moulding apparatus in the form of an injection of metal particles, which can e.g. be of copper and iron and whose dimensions are below 1 micrometer.

For example, for a cable in which the polymer is commercially available polyethylene, 3% of iron particles with dimensions between 0.1 and 0.5 micrometer were added. Over a 12 month period the effect of this treatment was measured. The results are given in the FIGURE, which plots the time in months on the abscissa and the electric shock behaviour in MV/cm on the ordinate. Curve 1 is that of an untreated cable and curve 2 that of a cable treated according to the invention.

We claim:

1. A method of reducing breakdown risk of a ceramic insulant of high voltage lines and cables, said ceramic insulant having a mass and a surface and having joints of grains, said method comprising the steps of:

depositing a predetermined mass of metal oxide particles on the surface of said ceramic insulant, said particles having a diameter of less than about one micrometer; and heating the ceramic insulant and deposited metal oxide to a temperature sufficient to allow diffusion of a mass of metal formed from said metal oxide into the joints of grains of the ceramic insulant.

2. The method of claim 1, wherein the step of depositing a predetermined mass of metal oxide particles comprises painting the surface of said ceramic insulant with a metal oxide paint.

3. The method of claim 1, wherein the mass of the metal diffused into the joints of grains represents approximately 3% of the mass of the ceramic insulant.

4. The method of claim 1, wherein the ceramic insulant and deposited metal oxide are heated to at least 1,000° C.

5. The method according to claim 4, wherein the ceramic insulant and deposited metal oxide are heated to a temperature in the range from about 1,000° C. to about 1,500° C.

6. The method of claim 2, wherein the metal oxide paint is selected from the group consisting of chromium oxide, titanium oxide, and manganese oxide.

* * * * *